US009498782B2

(12) United States Patent
Katter

(10) Patent No.: US 9,498,782 B2
(45) Date of Patent: Nov. 22, 2016

(54) METHOD FOR CLASSIFYING ARTICLES AND METHOD FOR FABRICATING A MAGNETOCALORICALLY ACTIVE WORKING COMPONENT FOR MAGNETIC HEAT EXCHANGE

(71) Applicant: Vacuumschmelze GmbH & Co. KG, Hanau (DE)

(72) Inventor: Matthias Katter, Alzenau (DE)

(73) Assignee: VACUMMSCHMELZE GMBH & CO. KG, Hanau (DE)

( * ) Notice: Subject to any disclaimer, the term of this patent is extended or adjusted under 35 U.S.C. 154(b) by 661 days.

(21) Appl. No.: 13/798,795

(22) Filed: Mar. 13, 2013

(65) Prior Publication Data

US 2013/0243637 A1 Sep. 19, 2013
US 2015/0246360 A9 Sep. 3, 2015

Related U.S. Application Data

(60) Provisional application No. 61/610,229, filed on Mar. 13, 2012.

(51) Int. Cl.

| | |
|---|---|
| ***B03C 1/005*** | (2006.01) |
| ***B03C 1/02*** | (2006.01) |
| ***H01F 1/01*** | (2006.01) |
| ***B03C 1/30*** | (2006.01) |
| ***B03C 1/32*** | (2006.01) |

(52) U.S. Cl.
CPC ..... *B03C 1/005* (2013.01); *B03C 1/02* (2013.01); *B03C 1/30* (2013.01); *B03C 1/32* (2013.01); *H01F 1/015* (2013.01)

(58) Field of Classification Search
CPC ..... B03C 1/005; B03C 1/02; B03C 1/16; B03C 1/22; H01F 1/015
See application file for complete search history.

(56) References Cited

U.S. PATENT DOCUMENTS

| | | | | |
|---|---|---|---|---|
| 3,836,827 A * | 9/1974 | Cuthbertson | ..... | H01H 37/585 335/208 |
| 4,828,685 A * | 5/1989 | Stephens | ..... | B03C 1/005 209/11 |
| 6,112,903 A * | 9/2000 | Kimmel | ..... | B07C 5/3427 198/461.2 |
| 7,318,528 B1 * | 1/2008 | Hessabi | ..... | B03C 1/002 209/215 |
| 8,469,196 B2 * | 6/2013 | Birken | ..... | B03C 1/005 209/11 |

(Continued)

FOREIGN PATENT DOCUMENTS

| | | | | |
|---|---|---|---|---|
| CA | 996503 * | 9/1976 | ..... | B03C 1/02 |
| DE | 19753785 A1 | 6/1999 | | |

(Continued)

*Primary Examiner* — Joseph C Rodriguez
(74) *Attorney, Agent, or Firm* — Dickinson Wright PLLC

(57) ABSTRACT

A method for classifying articles comprising magnetocalorically active material according to magnetic transition temperature comprises providing a source of articles to be classified, the source comprising articles comprising magnetocalorically active materials having differing magnetic transition temperatures, sequentially applying a magnetic field at differing temperatures to the source, the magnetic field being sufficient to exert a magnetic force on the source that is greater than the inertia of a fraction of the articles causing the fraction of the articles to move and produce an article fraction, and collecting the article fraction at each temperature to provide a plurality of separate article fractions of differing magnetic transition temperature, thus classifying the articles comprising magnetocalorically active material according to magnetic transition temperature.

30 Claims, 15 Drawing Sheets

(56) References Cited

U.S. PATENT DOCUMENTS

| | | | | |
|---|---|---|---|---|
| 8,616,362 | B1 * | 12/2013 | Browne | B03C 1/20 198/381 |
| 8,938,872 | B2 * | 1/2015 | Katter | H01F 1/015 29/458 |
| 2008/0283447 | A1 | 11/2008 | Grey et al. | |
| 2012/0043066 | A9 * | 2/2012 | Reppel | F25B 21/00 165/185 |

FOREIGN PATENT DOCUMENTS

| | | | |
|---|---|---|---|
| JP | 62-210064 | A | 9/1987 |
| JP | 2001-219093 | A | 8/2001 |
| SU | 1407546 | A1 | 7/1988 |
| WO | 2009-090442 | A1 | 7/2009 |

* cited by examiner

METHOD FOR CLASSIFYING ARTICLES AND METHOD FOR FABRICATING A MAGNETOCALORICALLY ACTIVE WORKING COMPONENT FOR MAGNETIC HEAT EXCHANGE

BACKGROUND

Field

The present application relates to methods for classifying articles, in particular for classifying particles comprising magnetocalorically active material, and methods for fabricating a magnetocalorically active working component for magnetic heat exchange.

Description of Related Art

The magnetocaloric effect describes the adiabatic conversion of a magnetically induced entropy change to the evolution or absorption of heat. Therefore, by applying a magnetic field to a magnetocaloric material, an entropy change can be induced which results in the evolution or absorption of heat. This effect is harnessed in magnetic heat exchangers to provide refrigeration and/or heating.

Materials such as $Gd_5(Si_5Ge)_4$, Mn(As,Sb) and $MnFe(P_5, As)$ have been developed which have a magnetic transition temperature, or Curie Temperature, at or near room temperature. The magnetic transition temperature translates to the operating temperature of the material in a magnetic heat exchange system. Consequently, these materials are suitable for use in applications such as building climate control, domestic and industrial refrigerators and freezers as well as automotive climate control.

Magnetic heat exchange technology is of interest as magnetic heat exchangers are, in principle, more energy efficient than gas compression/expansion cycle systems. Furthermore, magnetic heat exchangers are environmentally friendly as ozone depleting chemicals such as CFCs are not used.

WO 2009/090442 discloses a composite article which includes a plurality of layers, each comprising magnetocalorically active material. Each layer has a different magnetic transition temperature and the layers are arranged such that the magnetic transition temperature increases from one end of the composite article to the other to provide a layered working component for magnetic heat exchange. This layered arrangement of increasing or decreasing magnetic transition temperatures enables the operating range of the working component to be increased compared to a working component which includes magnetocalorically active material having a single magnetic transition temperature.

In order to manufacture such a layered working component, a plurality of magnetocalorically active materials in the form of powders may be used. Each magnetocalorically active material has a different Curie temperature. Therefore, methods for manufacturing a plurality of magnetocalorically active materials of differing magnetic transition temperature are desirable.

SUMMARY

In an embodiment is disclosed a method for classifying articles comprising magnetocalorically active material according to magnetic transition temperature comprises the following. A source comprising a plurality of articles to be classified is provided. The source includes articles comprising magnetocalorically active materials having differing magnetic transition temperatures. A magnetic field is applied to the source, sequentially, at differing temperatures. The applied magnetic field is sufficient to exert a magnetic force on the source that is greater than the inertia of a fraction of the articles. The magnetic force causes this fraction of the articles to move and as a result, an article fraction is produced. An article fraction is collected at each temperature to provide a plurality of separate article fractions each having a differing magnetic transition temperature. The articles comprising magnetocalorically active material are, therefore, classified according to magnetic transition temperature.

The method produces a plurality of separate article fractions, each comprising magnetocalorically active material having a different average magnetic transition temperature. The plurality of separate article fractions are obtained from a single source comprising a mixture of articles comprising magnetocalorically active material having differing magnetic transition temperatures. Therefore, the method classifies the articles comprising magnetocalorically active material according to magnetic transition temperature as each article fraction has a different average magnetic transition temperature. The method can be described as a thermomagnetic separation method.

A magnetocalorically active material is defined herein as a material which undergoes a change in entropy when it is subjected to a magnetic field. The entropy change may be the re-suit of a change from ferromagnetic to paramagnetic behaviour, for example. The temperature at which a magnetic transition from ferromagnetic to paramagnetic behaviour occurs is also known as the Curie temperature. The entropy change may also be the result of a change from antiferromagntic to ferromagnetic behaviour. It may also result from any kind of magnetic spin reorientation transition.

The articles may have many forms. For example, in some embodiments, the articles comprise particles of a powder and have a diameter of less than 2 mm (millimeter). In some embodiments, the articles can be considered fragments or components and may have at least one dimension which is larger than 2 mm (millimeter).

In an embodiment, the magnetocalorically active material has a magnetic transition temperature in the range 220K to 345K. The operating temperature of the magnetocalorically active material, when used in a magnetic heat exchange system, is approximately that of its magnetic transition temperature. A magnetocalorically active material with a magnetic transition temperature in the range 220K to 345K is suitable for applications such as domestic and commercial freezer systems, refrigeration, air conditioning or climate control systems depending on the desired operating temperature and operating temperature range.

The magnetocalorically active material may be one of Gd, a $La(Fe_{1-b}Si_b)_3$-based phase, a $Gd_5(Si,Ge)_4$-based phase, a Mn(As,Sb)-based phase, a MnFe(P,As)-based phase, a Tb—Gd-based phase, a $(La,Ca,Pr,Nd,Sr)MnO_3$-based phase, a Co—Mn—(Si,Ge)-based phase, a Ni(Mn,Co,Fe) (Sn,In, Ge)-based phase or a $Pr_2(Fe,Co)_{17}$-based phase. These basic compositions may further comprise further chemical elements which may substitute partially or in full for the listed elements. These phases may also comprise elements which are accommodated at least in part interstitially within the crystal structure, for example, hydrogen. These phases may also include impurity elements and small amounts of elements such as oxygen.

In the case that the magnetic transition is a transition from the ferromagnetic to the paramagnetic state, the method uses the feature that the saturation magnetization of articles comprising magnetocalorically active material is greater at temperatures below its magnetic transition temperature than at temperatures above its magnetic transition temperature. Therefore, by applying a magnetic field at differing temperatures, articles within the source having a magnetic transition temperature at, or close to, the applied temperature will be magnetised to a greater extent than further articles within the source having a magnetic transition temperature which is lower than the applied temperature. Therefore, the more highly magnetized articles will be subjected to a larger magnetic force and be caused to move, thus enabling these articles to be separated from the remaining articles.

The articles which are more highly magnetized have a magnetic transition temperature which is around that of the temperature applied to the source. Consequently, articles having a particular magnetic transition temperature can be separated from a source comprising articles having a plurality of different magnetic transition temperatures by applying a magnetic field gradient at a temperature to the source which approximates that of the desired magnetic transition temperature of the removed articles.

In the case that during the magnetic transition, the saturation magnetisation increases with increasing temperature, for example during an anti-ferromagnetic to ferromagnetic transition, articles with a transition temperature lower than the actual separation temperature will be attracted by the magnetic field.

The method also enables the production of an article fraction with a smaller magnetic transition temperature range than for article fractions obtained by other methods, for example by producing batches of magnetocalorically active powder having a composition designed to produce a particular magnetic transition temperature.

This narrow range of the magnetic transition temperature of the article fraction may be used to produce a layered article in which each layer has a more clearly defined magnetic transition temperature. This arrangement enables the efficiency of the working component comprising these layers of differing magnetic transition temperature to be increased and, consequently, the efficiency of the magnetic heat exchanger to be increased.

In an embodiment, the temperature of the source is set at a temperature T1 corresponding to a first desired magnetic transition temperature $T_{trans1}$. A magnetic field is applied to the source whilst the source is at temperature T1, causing a first article fraction within the source having a magnetic transition temperature of $T_{trans1}\pm3°$ C. to be magnetically attracted to the magnet and removed from the source. The first article fraction is then collected.

In order to remove an article fraction from the source, the strength of the magnetic field applied to the source at a particular temperature and for a particular geometry of the articles is chosen such that, ideally, the articles are magnetically saturated.

The first article fraction comprises articles of magnetocalorically active material which have a magnetic transition temperature within ±3° C. of the desired magnetic transition temperature $T_{trans1}$ to be moved from the source.

Preferably, the first article fraction has a magnetic transition temperature within ±1° C. of the desired magnetic transition temperature $T_{trans1}$.

In a further embodiment, the temperature of the source is altered to a temperature T2 corresponding to a second desired magnetic transition temperature $T_{trans2}$ wherein $T_{trans2}\neq T_{trans1}$ and T2≠T1. A magnetic field is applied to the source whilst the source is at temperature T2, causing a second article fraction within the source having a magnetic transition temperature of $T_{trans2}\pm3°$ C. to be magnetically attracted to the magnet and removed from the source. The second article fraction is collected.

The second article fraction has an average magnetic transition temperature which is different to the average magnetic transition temperature of the first article fraction since the second article fraction is collected at a temperature T2, which is different from the temperature T1.

Preferably, the second article fraction has a magnetic transition temperature within ±1° C. of the desired magnetic transition temperature $T_{trans2}$.

To classify one or more further article fractions from the source which have still further differing average magnetic transition temperatures, the temperature applied to the source may be altered to yet further differing temperatures, and at each differing temperature, a magnetic field is applied and the articles, which have a magnetic transition temperature within around 3° C. of the temperature at which the source is held, are attracted by the magnetic field, are caused to move and may be removed from source.

The difference between the average magnetic transition temperatures of the various article fractions may be determined by appropriate selection of the temperatures applied to the source. For example, the difference between the temperatures T1 and T2 may lie within the range of 0.5° C. to 5° C., i.e. $0.5° C. \leq |T_2-T_1| \leq 5° C.$ In one embodiment, the source is placed in a thermally conductive container. The temperature of the container may be altered to alter the temperature of the source by thermal conduction. In one embodiment, the container is thermally coupled to a bath, for example by a heating and/or cooling circuit. The temperature of the bath is altered to alter the temperature of the source by thermal conduction between the heating/cooling circuit and the source.

The source is held, sequentially, at a plurality of different temperatures. At each temperature, a magnetic field is applied and an article fraction having a magnetic transition temperature approximately that of the temperature of the source is removed. Such a method may be described as a static method.

In further embodiments, a continuous process may be used. In these embodiments, the source is subjected to a temperature gradient and the source is moved along the temperature gradient to alter the temperature of the source by thermal conduction. An article fraction is removed from the source at different points and at different temperatures along the temperature gradient. This method may be used for a continuously supplied source which moves continuously through the temperature gradient.

Two or more means for applying a magnetic field may be arranged at intervals along the temperature gradient so as to apply a magnetic field to the source at different points along the temperature gradient and, therefore, at different temperatures. This method allows article fractions of differing magnetic transition temperature to be removed from the moving source, sequentially, as the source moves along the temperature gradient.

In one embodiment, the source is moved along the temperature gradient from a higher temperature to a lower temperature. This embodiment may be used for articles which display a magnetic transition from a high magnetization to a low magnetization for increasing temperature. Examples of these materials are LaFeSi- and MnFePAs-based materials. This arrangement also makes use of inherent heat dissipation if the high temperature is above the ambient temperature. This may simplify the production of a temperature gradient as the source moves through the temperature gradient.

In an alternative embodiment, the source is moved through the temperature gradient from a lower temperature to a higher temperature. This embodiment may be used for articles which display a magnetic transition from a low magnetization to a high magnetization for increasing temperature. Examples of these materials are CoMnSi- and NiMnGa-based systems.

In one embodiment, the source is placed on a band which carries the source through the temperature gradient. The band may have the form of a driven belt having a direction of movement which corresponds to the direction of the temperature gradient. Alternatively, or in addition, the source may be moved along the band by vibration of the band.

The source may be moved continuously along the band by vibration or otherwise and the magnetic field may be applied at distances or intervals along the band, whereby the source has a different temperature at each distance or interval at which the magnetic field is applied.

The magnetic field may be applied perpendicularly to the surface of the band supporting the source and perpendicularly to the direction of movement of the source. In terms of Cartesian coordinates, if the direction of movement of the band and of the source is designated as the x direction, the width of the band may extend in the y direction and the magnetic fields may be applied in the z direction.

In some embodiments, the temperature gradient lies in the range of 10° C./m to 200° C./m. In one particular embodiment, the temperature at one end of the band is −10° C. and the temperature at the opposing end of the band is +60° C. The temperature gradient is 175° C./m. In this embodiment, the temperature gradient is applied over a distance of around 40 cm.

The magnetic field may be applied to the source by applying a current to an electromagnet. Alternatively, a permanent magnet may be used to apply the magnetic field.

The field strength applied to the source may be increased to a threshold at which the articles are sufficiently magnetized to be brought into motion by increasing the magnetic field gradient applied to the source. This may be performed, for example, by decreasing the distance between the permanent magnet and the source or by increasing the current flowing in the coil of an electromagnet.

The magnetic field may be produced by positioning a first magnet adjacent a first side of the source. In a further embodiment, a further magnet is positioned adjacent the opposing side of the source. The combination of the two magnets may be used not only to adjust the strength of the magnetic field applied to the source but also to adjust the gradient of the magnetic field. A magnetic field applied may lie in the range 0.003 T to 0.3 T or 0.01 T to 0.1 T. The magnetic gradient may be 0.5 T/m to 10 T/m.

As discussed above, the method makes use of the feature that the magnetisation of the articles is higher for articles comprising a magnetocalorically active material having a magnetic transition temperature which is around that of the temperature applied to the source than is the magnetisation of articles comprising a magnetocalorically active material having a magnetic transition temperature that is not around that of the temperature applied to the source. This degree of magnetisation can be further optimised by applying a magnetic field having a strength that is dependent on the magnetic polarization of articles having a particular shape. In the case of isotropic articles, for example, spherical articles, the magnetic field B applied to the source may be at least $J_s/3$ in order to saturate the articles at the applied temperature.

After the articles have been removed from the source, the removed article fraction may be secured on a removal surface, for example a surface of the magnet before being transferred to a collection container.

The application also relates to the use of magnetic separation at a plurality of different temperatures to produce a plurality of particle fractions having differing magnetic transition temperatures from a source comprising a plurality of particles of differing magnetic transition temperatures. The particles may comprise a $La(Fe,Si)_{13}$-based phase. In further embodiments, the particles comprise one or more of the following phases: a $Gd_5(Si,Ge)_4$-based phase, a Mn(As, Sb)-based phase, a MnFe(P,As)-based phase, a Tb—Gd-based phase, a $(La,Ca,Pr,Nd,Sr)MnO_3$-based phase, a Co—Mn—(Si,Ge)-based phase and a $Pr_2(Fe,Co)_{17}$-based phase.

A method of fabricating a magnetocalorically active working component for magnetic heat exchange is also provided. The method comprises obtaining a plurality of particle fractions each having a different magnetic transition temperature using the method according to one of the embodiments described above. The particle fractions are arranged in order of increasing or decreasing magnetic transition temperature and a magnetocalorically active working component for magnetic heat exchange is produced.

The particle fractions may be arranged so as to produce a layered type structure in which the average magnetic transition temperature of the layer increases or decreases in the working direction of the magnetocalorically active working component.

The average magnetic transition temperature, of the particles of a fraction lies within a smaller range of the average magnetic transition temperature of the particles of the fraction due to the use of thermomagnetic separation to classify the particle fractions from the source. This increases the efficiency of the working component over one in which the magnetic transition temperature of the particles within a particle fraction or within a layer in the case of a layered component is greater.

A first particle fraction may be compacted before a further particle fraction having a different magnetic transition temperature is arranged on the first particle fraction. The further particle fraction may then be compacted. This method may be used to build up a layered working component in which each layer has a different average magnetic transition temperature.

In some embodiments, after the particle fractions are arranged in order of increasing or decreasing magnetic transition temperature, the arrangement is heat treated and a sintered magnetocalorically active working component for magnetic heat exchange is produced. The heat treatment may be used to increase the mechanical integrity of the working component.

Suitable heat treatment conditions to produce a sintered working component may be in the range of 300° C. to 1200° C. for 2 hours to 10 hours for $La(Fe,Si)_{13}$-based phases, for example. The compaction to form the green body may be carried out at pressures in the range of 10 MPa to 300 MPa and optionally at temperatures other than room temperature such as 30° C. to 250° C.

In a further embodiment, the particles of the particle fractions are mixed with adhesive before compaction. After compaction of the particle/adhesive mixture, the adhesive may be cured. The way in which the adhesive is cured depends on the composition of the adhesive. The adhesive may be cured by heat treatment, for example at a temperature in the range of 0° C. to 200° C. The adhesive may be cured by subjecting it to UV light, for example.

BRIEF DESCRIPTION OF DRAWINGS

Embodiments will now be described with reference to the accompanying drawings.

DETAILED DESCRIPTION OF SPECIFIC EMBODIMENTS

In the following embodiments, the articles separated by thermomagnetic separation are particles separated from a powder source. The particles have an average diameter, determined by sieving of 50 μm to 750 μm. However, the methods described may also be used for separating larger or smaller articles from a source by adjusting the magnetic field strength and magnetic field gradient depending on the size, shape and the magnetic polarization of the articles.

Figure 1:
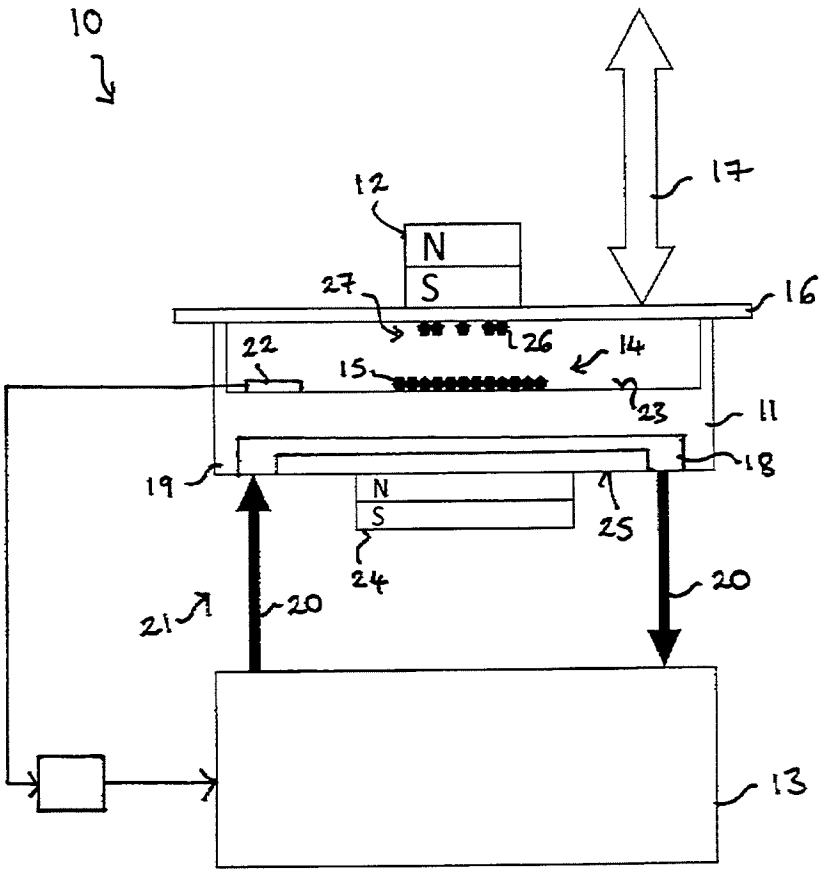
FIG. 1 schematically illustrates apparatus according to a first embodiment for classifying magnetocalorically active articles using thermomagnetic separation.

FIG. 1 illustrates apparatus 10 according to a first embodiment for classifying magnetocalorically active particles using thermomagnetic separation.

The apparatus 10 comprises a container 11, which is thermally conductive and non-magnetic, a magnet 12 and means for adjusting the temperature of the container 11 in the form of a bath 13 which can be heated or cooled to adjust the temperature of the container 11. The container 11 is open on its upper side and may comprise copper.

The source 14 of magnetocalorically active particles 15 which are to be classified are placed in the thermally conductive container 11. The source 14 comprises a plurality of particles 15 comprising magnetocalorically active materials having differing magnetic transition temperatures. In this embodiment, the majority of the particles 15 comprise magnetocalorically active material. However, some impurity particles may also be present which do not include magnetocalorically active material.

In one particular embodiment, the magnetocalorically active material of the particles is a $La(FeSi)_{13}$-based phase. Impurity particles may comprise alpha-iron, for example.

The source 14 is placed within the container 11 and the container 11 is closed by means of a non-magnetic lid 16. The magnet 12 is positioned above the lid 16 and is movable relative to the source 14 so as to adjust the magnetic field strength and magnetic gradient applied across the source 14. Movement of the magnet 12 and of the lid 16 is indicated with arrow 17. In one particular embodiment, the magnetic field is 0.03 T and the magnetic field gradient is 2.2 T/m.

The temperature of the container 11 may be adjusted by providing channels 18 in the base 19 of the container 11 which are in flow communication with the cooling and heating bath 13. The temperature of the bath 13 may be adjusted and the liquid allowed to flow through the channels 18 in the base 19 of the container 11. The channels 18 in the base 19, the bath 13 and the circuit 20 coupling the channels 18 to the bath 13 provide a heating/cooling circuit 21 for the source 14. The temperature of the container 11 and of the source 14 is adjusted by thermal conduction of heat from or to the liquid flowing in the heating/cooling circuit 21. The temperature of the container 11 and a source 14 may be measured by means of a thermocouple 22 attached to the inner surface 23 of the base 19 of the container 11.

Also illustrated in FIG. 1 is an optional second magnet 24 which is positioned adjacent the lower surface 25 of the base 19 of the container 11. The second magnet 24 may be used to adjust the magnetic field strength and magnetic field gradient across the source 14.

In this particular embodiment, the magnets 12, 24 are permanent magnets and the particles 15 of the source 14 have a diameter in the range of 400 μm to 500 μm. After adjusting the temperature of the bath 13, the temperature of the container 11 is monitored and, when the thermocouple 22 indicates that the desired temperature has been reached, a dwell is used to ensure that the temperature of the particles 15 of the source 14 corresponds to that measured for the container 11.

The lid 16 is mounted on the open side of the container 11, and the temperature is allowed to stabilise. The magnet 12 is brought towards the lid 16 to increase the magnetic field gradient across the source 14. Some of the particles 26 are attracted to the inside of the lid 16 due to the increased magnetic field provided by the magnet 12. These particles ad-here to the inside of the lid 16.

In order to remove the first particle fraction 27, the lid 16 is removed together with the magnet 12 from the container 11 while the removed particles 26 are still attracted by the magnet 12. Finally the magnet 12 is removed from the lid 16 and the removed particles 26 can be collected in a container.

These removed particles 26 form a first particle fraction 27 classified from the source 14. The first particle fraction 27 has an average magnetic transition temperature which corresponds to the material having the largest magnetisation polarization at this particular temperature. The average magnetic transition temperature of the first particle fraction 27 corresponds to the temperature applied to the source.

The temperature of the source 14 is then changed by changing the temperature of the heating and cooling bath 13. After the new temperature has been reached, the method described above is repeated to remove a second particle fraction from the source 14. The particles of the second particle fraction have an average magnetic transition temperature which corresponds to the second temperature applied to the source 14. The average magnetic transition temperature of the second particle fraction is different to the average magnetic transition temperature of the first particle fraction 27.

This apparatus may be used to carry out a static or batch type thermomagnetic separation process.

Figure 2:
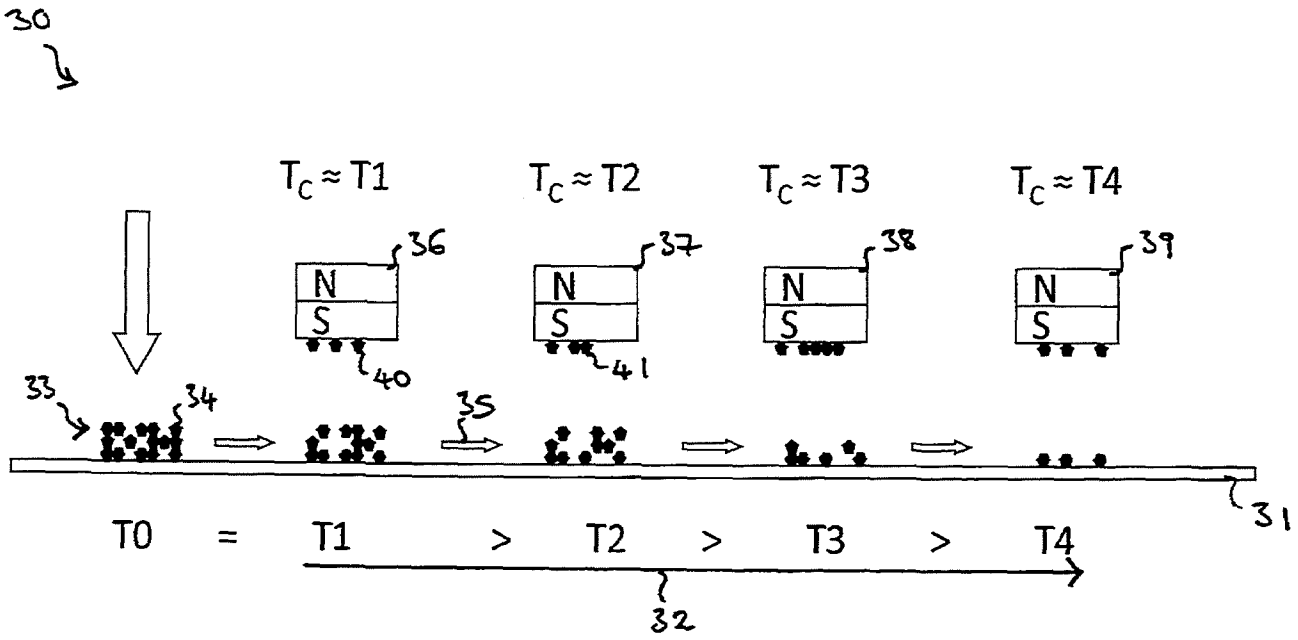
FIG. 2 schematically illustrates apparatus according to a second embodiment for classifying magnetocalorically active articles using thermomagnetic separation.

FIG. 2 illustrates apparatus 30 according to a second embodiment which is used to classify magnetocalorically active particles.

The apparatus 30 comprises a band 31 and a temperature gradient 32. A source 33 comprising particles 34 of magnetocalorically active material which are to be classified, is trans-ported through the temperature gradient 32 by movement of the band 31. In this particular embodiment, the band 31 vibrates in order to move the source 33 through the temperature gradient 32 in direction of the arrow 35.

In other embodiments, the band 31 may move the source 33 along the temperature gradient 32 by movement of the band 31 in the direction of the temperature gradient 32. The band 31 may be a conveyor belt, for example.

The apparatus 30 further comprises a plurality of magnets 36, 37, 38, 39 which are spaced at intervals along the length of the band 31. Each of the plurality of magnets 36, 37, 38, 39 is positioned above the band 31 at a different temperature due to the temperature gradient 32. The majority of the particles 34 of the source 33 comprise magnetocalorically active material. The magnetic transition temperature of the particles 34 differs due to differing compositions of the magnetocalorically active material.

The band 31 transports the source 33 through the temperature gradient 32 and underneath the plurality of magnets 36, 37, 38, 39 at a speed suitable to ensure that the temperature of the source 33 corresponds to that of the temperature gradient 32. Therefore, as the source 33 reaches magnet 36, it has a temperature T1. Consequently, particles which are highly magnetised at temperature T1 by the magnetic field produced by magnet 36 are attracted to the magnet 36 and removed from the source 33 on the band 31 producing a first particle fraction 40.

As the source 33 progresses through the temperature gradient 32, it has a temperature T2, which is less than T1, as it is positioned beneath the magnet 37. Particles which are highly magnetised and, preferably, saturated at temperature T2 due to the presence of the magnetic field provided by the magnet 37 are attracted, thus separating these particles from the source 33 and producing a second particle fraction 41.

The source 33 can continuously be fed onto the start of the band 31 and particle fractions removed from the source 33 at intervals along the band 31 due to the positioning of the magnets. Four magnets 36, 37, 38, 39 are illustrated in FIG. 2 which are arranged to remove particle fractions sequentially from the source at decreasing temperatures. However, the number of magnets and particle fractions classified from the source is not limited to four. The number of particle fractions classified from source 33 can be adjusted by adjusting the number of magnets and the temperature range over which the temperature gradient is provided. The temperature gradient may be increasing in the direction of movement of the source, instead of decreasing.

The magnets 36, 37, 38, 39 may be merged and form a single elongated magnet allowing, in principle, continuous separation. The magnets 36, 37, 38, 39 may be orientated with their magnetization direction perpendicular to the major surface of the band 31 as illustrated in FIG. 2. However, they may also be orientated parallel to the band. In this parallel arrangement, the magnets may be rotated about an axis perpendicular to the plane of the band. The resulting steering effect within the source 33 supports the extraction of the individual particles from the source.

The apparatus 30 according to the second embodiment may be used to provide a continuous thermomagnetic separation process for classifying particles comprising magnetocalorically active material from a source comprising a plurality of particles comprising magnetocalorically active material having differing magnetic transition temperatures.

In alternative embodiments, the particles are separated from the source with the aid of a further magnet system which determines their path. For example, if a horizontal band is moved over a cylindrical magnet system, particles having a high saturation magnetisation are directed along a lower parabolic path than particles having a lower saturation magnetisation. Therefore, the two types of particles can be separated from one another.

Figure 3:
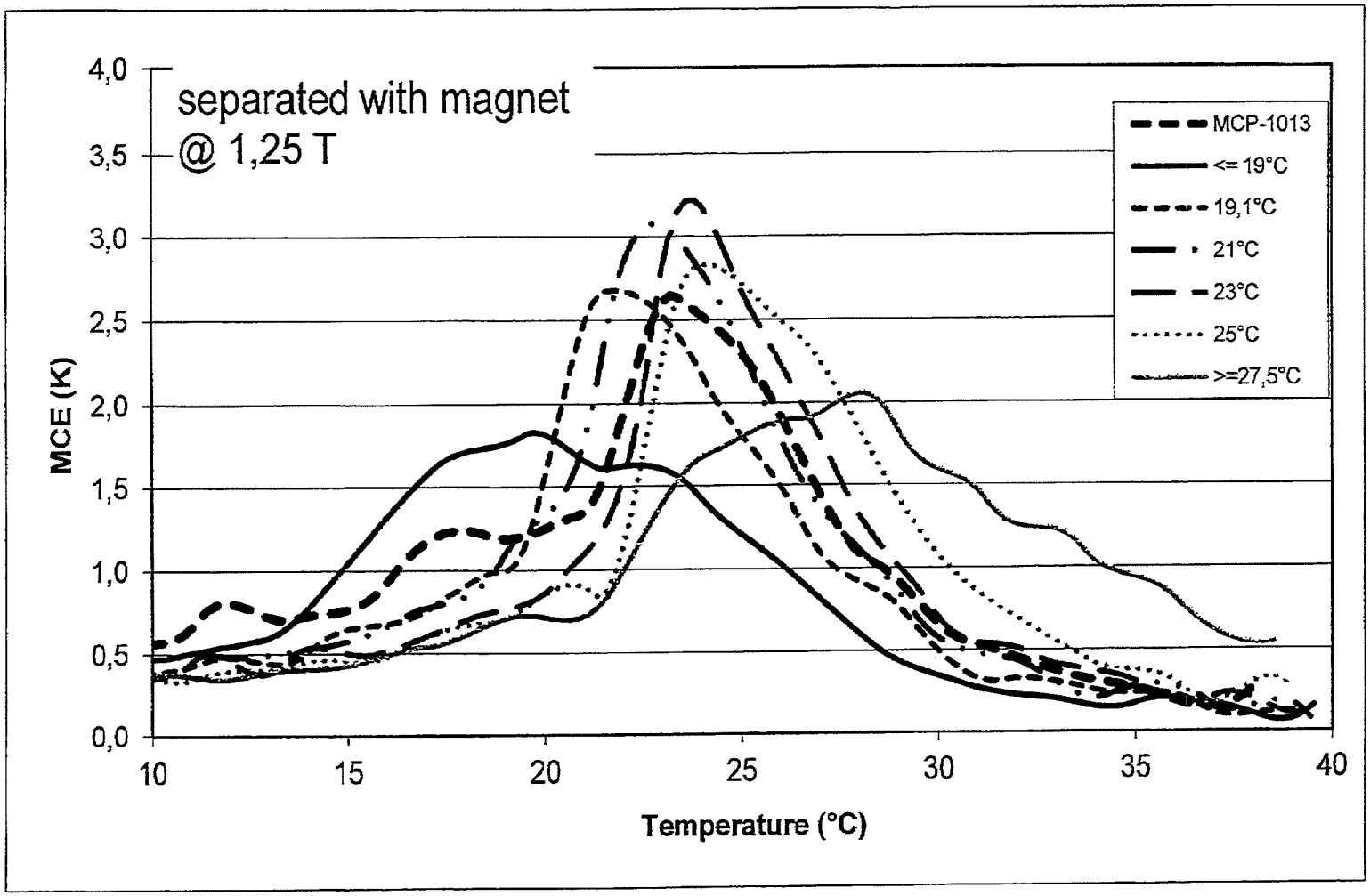
FIG. 3 illustrates a graph of magnetocaloric entropy as a function of temperature for a first source.

FIG. 3 illustrates a graph of the adiabatic temperature change which may also be termed the magnetocaloric effect (MCE) as a function of temperature for a sample according to a first embodiment. The source comprises particles having a diameter of 400 μm to 500 μm and a nominal composition of $LaFe_{11.42}Mn_{0.32}Si_{1.26}H_{1.53}$. A single permanent magnet was placed at a distance of around 20 mm from the source to provide a magnetic field of 0.03 T and a magnetic field gradient of 2.2 T/m.

The starting powder which has not yet been classified by a thermomagnetic separation process is indicated by the dashed line in FIG. 3. The magnetic transition temperature of the starting powder is around 24° C. as indicated by the position of the peak in the curve. The starting powder is subjected to the magnetic field at a plurality of different temperatures and a particle fraction is removed from the source at each of these temperatures. The interval between applied temperatures is 2K.

FIG. 3 illustrates a curve of magnetocaloric effect against temperature for each of these powder fractions. FIG. 3 illustrates that, except for the first fraction and the last fraction, the width of the peaks for the particle fractions is narrower than that of the starting power, indicating that the homogeneity of the individual particle fractions is bet-ter than the starting powder. Furthermore, the magnetocaloric effect of these particle fractions is greater than that for the starting mixture. The first fraction and the last fraction are those fractions removed at the highest and lowest temperature.

If the particle fractions having a peak temperature which is much higher and much lower than that of the peak temperature of the starting powder are removed, the homogeneity of the remaining powder may be improved. Therefore, the method may be used to remove particle fractions having magnetic transition temperatures outside of the desired peak width. The remaining powder, which although it could be classified into further particle fractions, may be left as a mixture, since the mixture has properties which are suitably uniform for a particular application.

Figure 4:
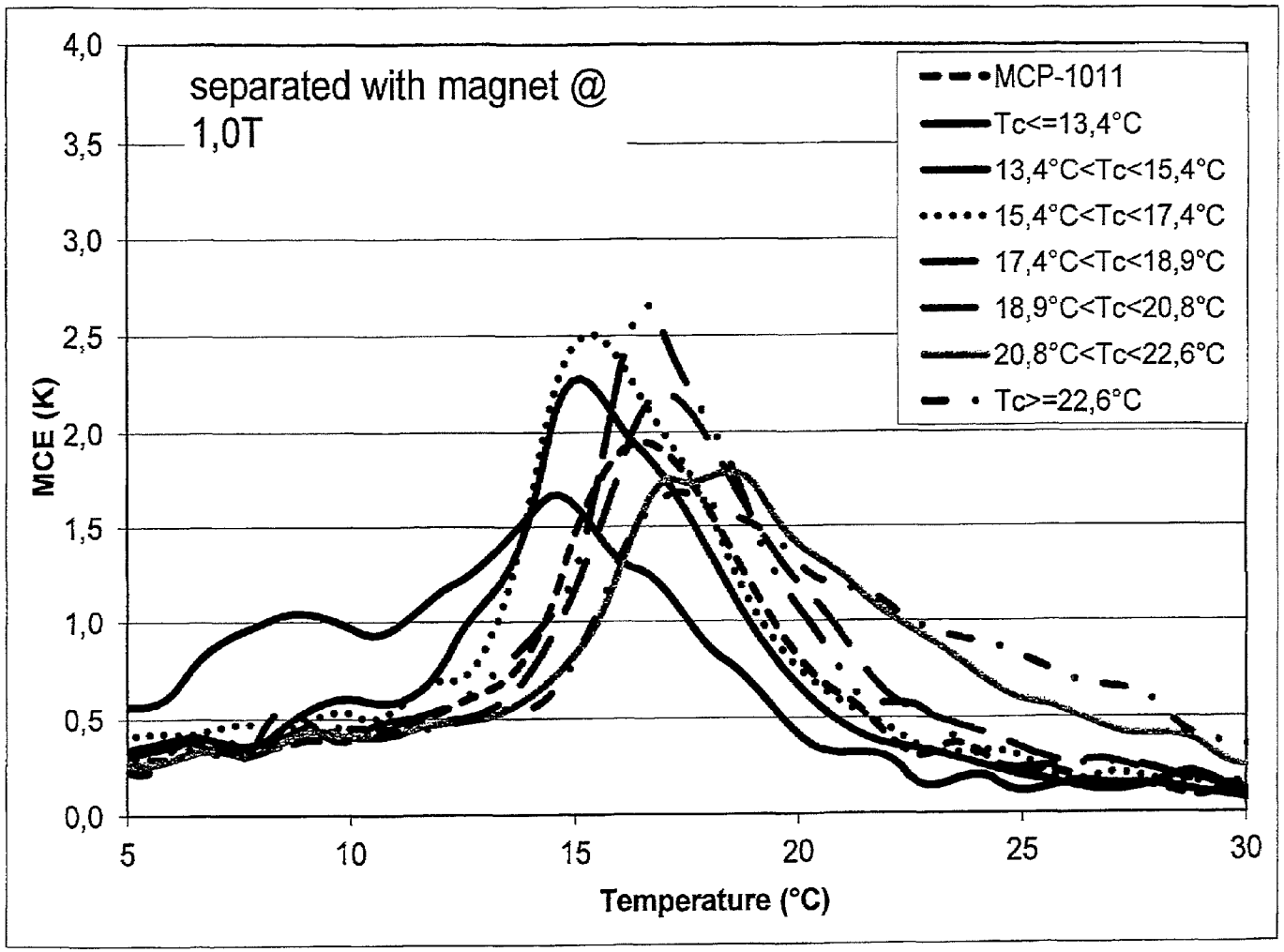
FIG. 4 illustrates a graph of magnetocaloric entropy as a function of temperature for a second source.

FIG. 4 illustrates a graph of magnetocaloric effect against temperature for a sample having a slightly differing composition of $LaFe_{11.39}Mn_{0.35}Si_{1.26}H_{1.53}$ and a lower magnetic transition temperature of 17° C. The particle size of the powder is 400 μm to 500 μm. The starting powder was subjected to a thermomagnetic separation process in which a magnetic field of 0.03 T having a gradient of 2.2 T/m was applied to the powder at a plurality of temperatures. The interval between the temperatures is around 2° C.

A plurality of particle fractions having differing peak temperatures is obtained. Particle fractions having a peak temperature closer to that of the starting powder have a higher magnetocaloric effect than that of the starting powder. These results indicate that a thermomagnetic separation process may be carried out successfully for starting powders having different average magnetic transition temperatures.

Figure 5:
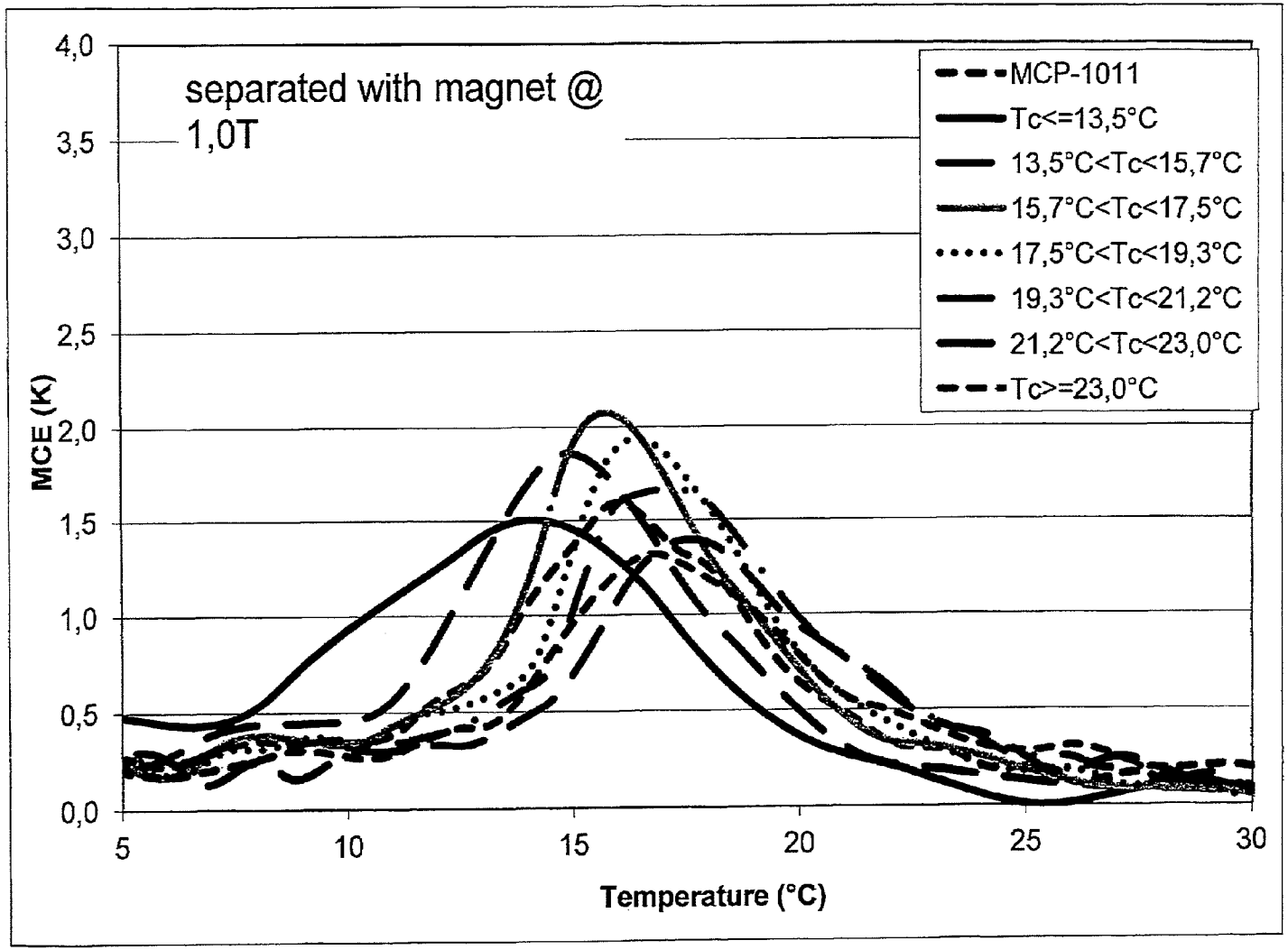
FIG. 5 illustrates a graph of magnetocaloric entropy as a function of temperature for a third source.

FIG. 5 illustrates a graph of magnetocalorically effect against temperature for a powder having a composition corresponding to that of FIG. 4: $LaFe_{11.39}Mn_{0.35}Si_{1.26}H_{1.53}$, and a magnetic transition temperature of 17° C. and an average particle size of less than 250 μm.

The powder was subjected to thermomagnetic separation at a plurality of differing temperatures, the interval between the temperatures being around 2K. The magnetocaloric effect is observed to increase for particle fractions having a magnetic transition temperature around that of the average magnetic transition temperature of 17° C. of the starting powder. These results indicate that thermomagnetic separation may also be used for starting powders of differing particle size.

Figure 6:
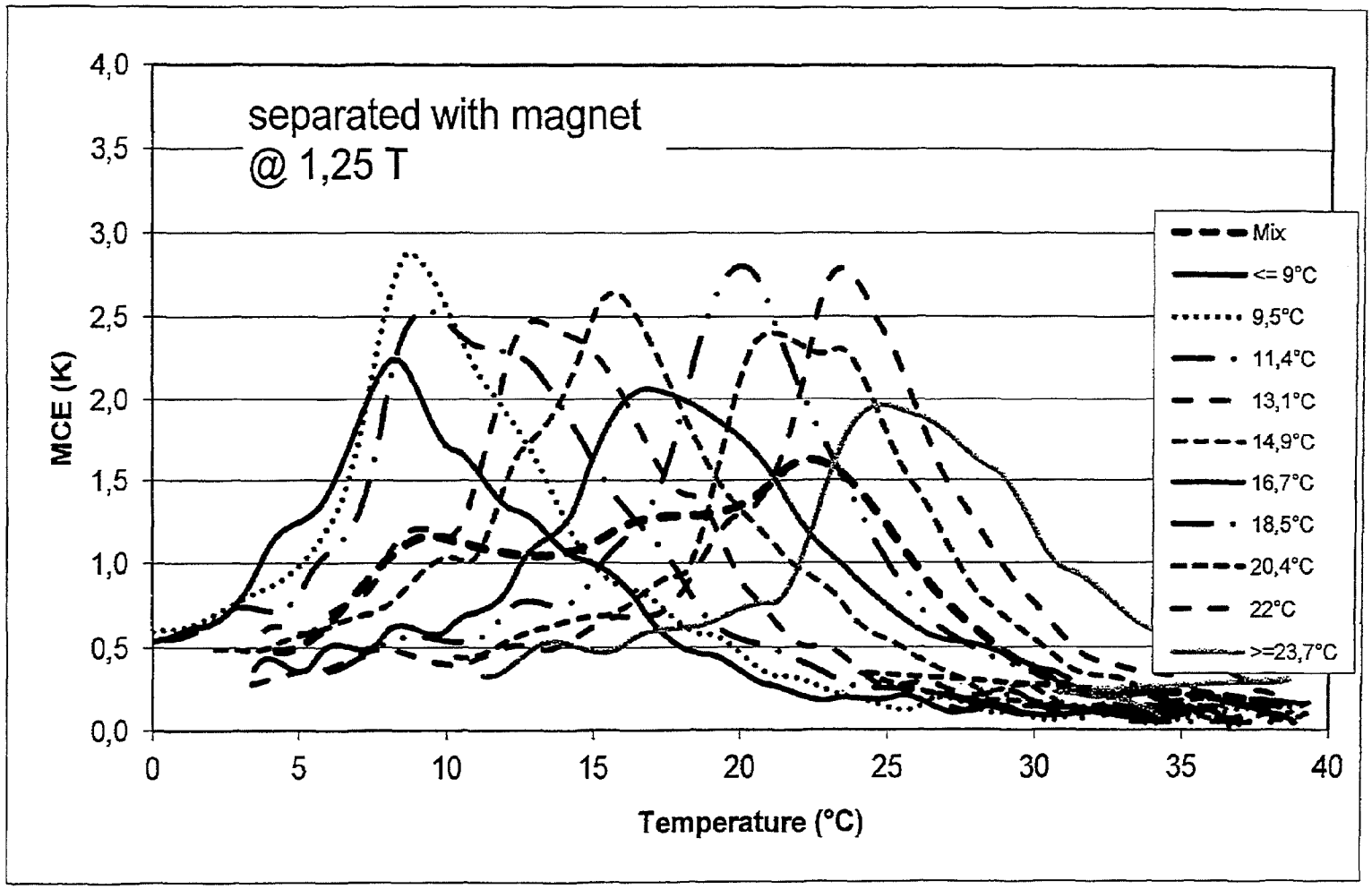
FIG. 6 illustrates a graph of magnetocaloric entropy as a function of temperature for a fourth source subjected to different thermomagnetic separation conditions.

FIG. 6 illustrates a graph of magnetocaloric effect against temperature for a sample having equal fractions of powders comprising a $La(FeSi)_{13}$ phase with differing manganese contents: $LaFe_{11.74}Mn_ySi_{1.26}H_{1.53}$, where y=0.32, 0.34, 0.36, 0.37, 0.39 having a ratio of 1:1:1:1:1. The particle size is 400 μm to 500 μm. The starting powder was subjected to a thermomagnetic separation process in which a magnetic field of 0.03 T having a gradient of 2.2 T/m was applied to the powder at a plurality of temperatures. The interval between the temperatures is 2° C.

The curve of magnetocloric effect (MCE) against temperature for the starting powder is indicated in FIG. 6 by the dashed line. The curve indicates that the powder comprises phases having differing magnetic transition temperatures and is not homogenous due to the very large width of the peak and the presence of sub-peaks.

The powder can be classified into a variety of particle fractions having a magnetocaloric effect greater than that of the starting powder. In some cases, the magnetocaloric effect is more than doubled. These results indicate that a powder mixture can also be classified into separate particle fractions which each have good homogeneity as indicated by the increased MCE values.

Figure 7:
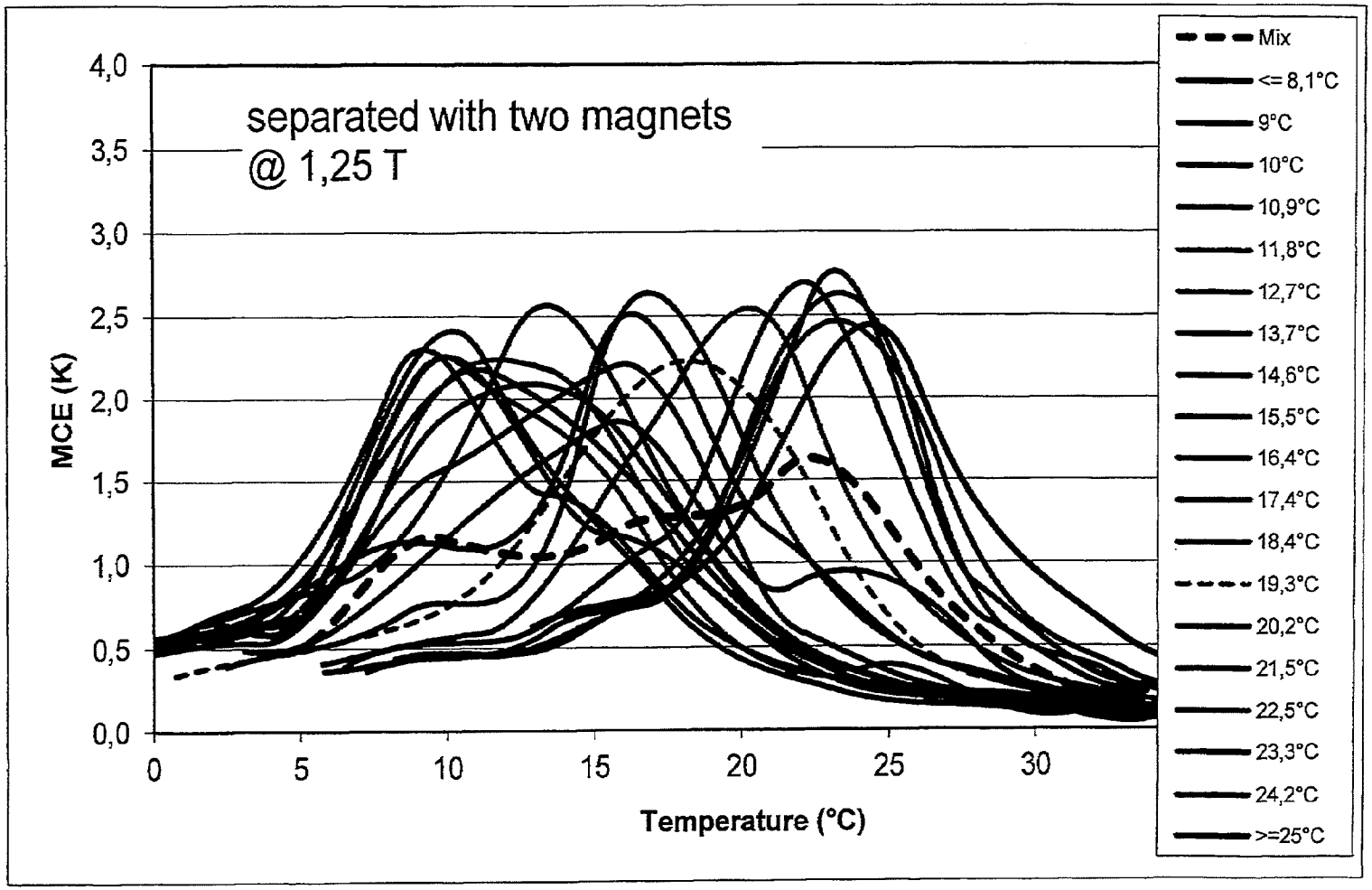
FIG. 7 illustrates a graph of magnetocaloric entropy as a function of temperature for the fourth source subjected to different thermomagnetic separation conditions.

FIG. 7 illustrates a graph of magnetocaloric effect against temperature illustrating the classification of the powder also used in the embodiment illustration FIG. 6. However, in the embodiment illustrated in FIG. 7, a second magnet was used during thermomagnetic separation. The second magnet is positioned on the opposing side of the source of starting powder. In this embodiment, a magnetic field of 0.08 T and a magnetic field gradient of 1 T/m is used. In this embodiment, the interval between temperatures at which the magnetic field was applied was reduced to 1 K. A plurality of particle fractions were removed from the starting powder at differing temperatures. Each particle fraction has a different peak temperature. This illustrates that thermomagnetic separation may also be carried out at a higher magnetic field.

Without being bound by theory, it is thought that the thermomagnetic separation method according to the embodiments described above may be based on one or more of the following concepts.

Some magnetocalorically active materials display a large temperature dependence of the saturation magnetisation in the region of their working temperature which generally corresponds to the magnetic transition temperature or Curie temperature. The magnetic transition temperature may also be strongly dependent on the composition of the magnetocalorically active phase. For example, the Curie temperature of the $La(Fe,Si)_{13}$ phase may be adjusted by substituting elements such as Mn and H. The Curie temperature decreases by −26K for 1 weight percent of Mn and increases by +700K for 1 weight percent of hydrogen.

If the Curie temperature is strongly dependent on the composition of the particles, magnetic separation at differing temperatures may be used to separate particle fractions from a mixture. The particle fractions have a narrow composition range, since compositions outside of the narrow range are not magnetically attracted as their saturation magnetization is too small at the set temperature.

Figure 8:
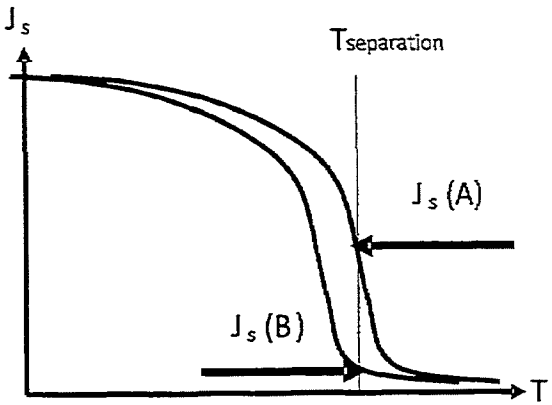
FIG. 8 illustrates a graph of saturation magnetization against temperature.

When a magnetic field is applied, which is large enough to saturate the particles, particles of differing magnetic transition temperatures are magnetised to differing degrees. FIG. 8 illustrates a graph of saturation magnetisation as a function of temperature for two magnetocalorically active materials A, B having differing compositions and differing magnetic transition temperatures.

FIG. 8 illustrates that at a predetermined separation temperature, $T_{separation}$, the magnetic polarisation is greater for sample A than sample B. If these particles are subject to a magnetic field gradient in addition to the magnetic field, the particles are subjected to magnetic forces as in addition to the gravitational force. The magnetic forces depend on the saturation magnetisation and, therefore, also depend on the Curie temperature of the particles. If the direction of the magnetic field gradient is selected so that the resulting magnetic force opposes the gravitational force and the value of the magnetic field gradient is selected so that the magnetic force on the particles A is greater than the gravitational force, but the magnetic force on the particles B is less than the gravitational force on particles B, particles A are forced to move against the gravitational force and can be separated from the mixture in certain embodiments of the method disclosed herein.

This principle may be used to separate a plurality of particle fractions from a single source by appropriate selection of the temperature and magnetic field and magnetic gradient, whereby the particle fractions have differing Curie temperatures.

Figure 9:
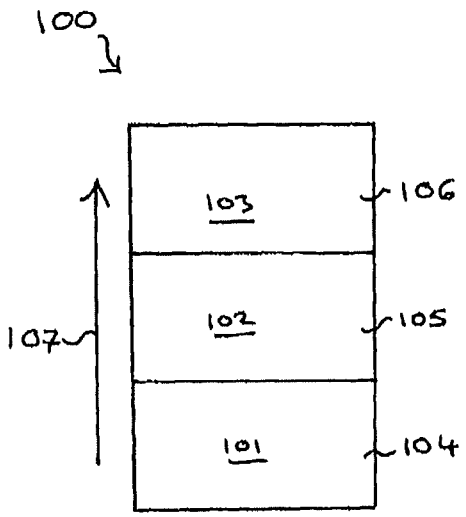
FIG. 9 schematically illustrates a working component fabricated using magnetocalorically active material classified according to the invention.

FIG. 9 illustrates a working component 100 for a magnetic heat exchanger which is fabricated from a plurality of particle fractions 101, 102, 103 classified using thermomagnetic separation, each of which comprise magnetocalorically active material.

The working component 100 has a layered structure including three layers 104, 105, 106 having different magnetic transition temperatures which increase or decrease along the working direction 107 of the working component 100. The working component 100 is, however, not limited to having only three layers. Fewer or more than three layers, and fewer or more than three different magnetic transition temperatures may also be used in a working component.

The working component 100 may be fabricated as follows. The particle fractions 101, 102, 103 are each mixed with an adhesive to produce three separate pastes. A paste comprising the first particle fraction 101 is compacted in a mold, the second article fraction 102 is placed on the compacted first particle fraction 101 and is itself compacted. The third particle fraction 103 is placed on the second particle fraction 102 and compacted to produce a green body.

The green body is then subjected to a heat treatment at temperatures in the range of 30° C. to 200° C. to cure the adhesive and produce the working component 100. The adhesive serves as a binder and may be used to increase the mechanical integrity of the working component 100 compared to a working component comprising only compacted particles. The amount of the binder is selected to so that an open porosity is formed in the working component. The open porosity enables a heat transfer fluid to flow through the working component. The heat transfer fluid may be pumped through the open porosity of the working component. In other embodiments, an adhesive is not used and the particle fractions are compacted without any adhesive.

In further non-illustrated embodiments, the working component 100 may be fabricated as follows. The particle fractions 101, 102, 103 are each placed in a layered manner in a mold as in the embodiment described above and the layered structure is compacted to produce a green body. The layers may be each compacted in turn as the layered structure is built up in the mold. The green body is then subjected to a heat treatment at temperatures to sinter the particles and produce a sintered working component 100.

Suitable heat treatment conditions may be in the range of 300° C. to 1200° C. for 2 hours to 10 hours for $La(Fe,Si)_{13}$-based phases, for example. The compaction to form the green body may be carried out at pressures in the range of 10 MPa to 300 MPa and optionally at temperatures other than room temperature such as 30° C. to 250° C.

Without being bound by theory, thermomagnetic separation (TMS) may make use of one or some of the following concepts.

Figure 10:
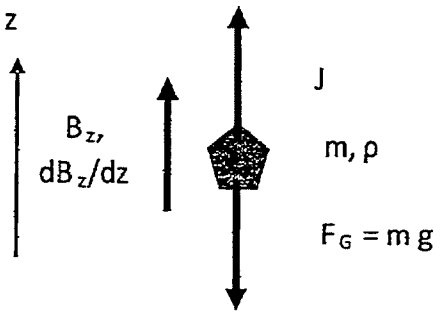
FIG. 10 schematically illustrates the forces acting on an individual particle in an inhomogeneous magnetic field.

The forces acting on an individual particle in an inhomogeneous magnetic field vertically oriented in z direction may be calculated. The conditions under consideration are illustrated in FIG. 10 where $B_z$ is the magnetic induction applied from outside in T, $dB_z/dz$ is the gradient in T/m, J is the polarisation in T, m is the mass in kg, ρ is the density in $kg/m^3$ and, finally, $F_G$ is the weight force in N.

Operating Point

Magnetic force and gravity act on the particle:

$$F_{mag} = \frac{J}{\mu_0} V \frac{dB_z}{dz} = \frac{Jm}{\mu_0 \rho} \frac{dB_z}{dz} \tag{1}$$

$$F_G = mg. \tag{2}$$

Making the two forces equal produces the equilibrium condition which describes the operating point of the thermomagnetic separation:

$$\mu_0 g \rho = J \frac{dB_z}{dz}. \tag{3}$$

Here the left side of the equation describes the influence of gravity and the right side of the equation magnetic force. As long as the gradient of the magnetic field can be assumed to be constant over the volume of the particle, the equilibrium condition is not dependent on the mass or the volume of the particle. The strength of the magnetic field is not explicitly included in the condition.

Saturation Condition

To produce a thermomagnetic separation function, the magnetic field has to be strong enough to magnetically saturate the magnetocalorically active phase of the particles which are to be sorted, i.e. removed from the source.

To calculate the necessary saturation field strength, it is assumed that the magnetocaloric particles are very easily magnetisable in the region of their magnetic transition temperatures and that the magnetisation behaviour is determined essentially by the particles' own demagnetising field. Such an assumption is considered permissible for $La(FeSi)_{13}$-based material in particular given its cubic crystal symmetry. In this case the macroscopically effective permeability is dependent only on the geometry and orientation of the particles and the following applies:

$$J = \mu_0 H_{ext}/N = B_z/N. \tag{4}$$

Figure 11:
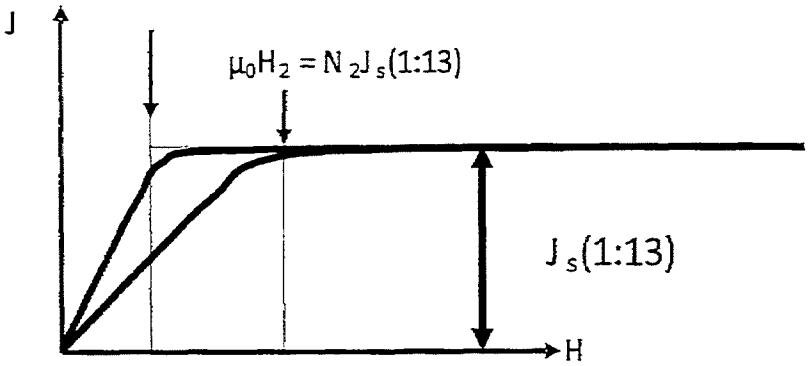
FIG. 11 illustrates a graph of magnetisation behaviour of magnetocaloric particles with different demagnetising factors.

$H_{ext}$ is the external magnetic field acting on the particle and N is the demagnetising factor acting in the direction of the magnetic field. $B_z$ is thus the magnetic induction acting in z direction at the location of the particle in the special case under consideration here. Different particle geometries result in different magnetisation curves, such as those shown in FIG. 11.

Here the saturation field strength $H_1$ is dependent on the demagnetisation factor of the particle in question. Since the particles are able to move freely they will always rotate such that their longest axes are oriented parallel to the magnetic field applied. As a result, the highest expected field strength required to saturate a particle occurs in the case of a spherical particle with N=⅓. For thermomagnetic separation the following condition is best fulfilled in addition to equation (3):

$$B_z > J_s/3. \tag{5}$$

If this condition is not met there is a possibility that those particles which can be most easily magnetized thanks to their shape along their longest axis are more likely to lift off. In such a case the particles would be sorted by shape rather than by Curie temperature as is desired.

Intermediate Phase Condition

LaFeSi alloy powders may contain a few percent of an αFe phase. The αFe phase may be undesired sintering residues which were not entirely dissolved during production, or may result from the metallic composition having been pushed to the Fe-rich side by increased oxygen uptake during the powder metallurgy processes used in manufacture. However, it is also possible to produce off-stoichiometric alloy powders intentionally to prevent the formation of the particularly corrosion-prone $LaFeSi_{13}$ phase. Fe inclusions naturally react to the magnetic field applied and result in force contributions undesirable for the thermomagnetic separation.

The αFe phase is generally present in the form of globular inclusions in the structure and on average it is possible to assume a demagnetisation factor of $N_{Fe}$=⅓. Since αFe has a saturation polarisation of approx. 2.16 T at room temperature, it will not be fully saturated until a field strength of approx. 0.7 T is reached and effective polarisation can be described as follows:

$$J_{Fe} = \mu_0 H_{ext}/N_{Fe} = 3B_z \tag{6}$$

This results in the following expression of the force component on the particle resulting from the αFe content:

$$F_{Fe} = \frac{3\alpha B_z m}{\mu_0 \rho} \frac{dB_z}{dz} \tag{7}$$

where α is the part by volume of αFe.

To produce thermomagnetic separation, $F_{Fe}$ should be less than the weight force acting on the particle, resulting in the following intermediate phase condition:

$$\mu_0 g\rho > 3\alpha B_z \frac{dB_z}{dz}. \tag{8}$$

Generally, it may also be taken into account that the phase fraction of the magnetocalorically active phase β is less than 100%. This results in the following conditions for the feasibility of thermomagnetic separation:

$$\mu_0 g\rho = (3\alpha B_z + \beta J_s)\frac{dB_z}{dz} \quad \text{lift-off condition} \tag{9}$$

$$B_z > J_s/3 \quad \text{saturation condition} \tag{10}$$

$$\mu_0 g\rho > 3\alpha B_z \frac{dB_z}{dz} \quad \text{intermediate phase condition} \tag{11}$$

Figure 12:
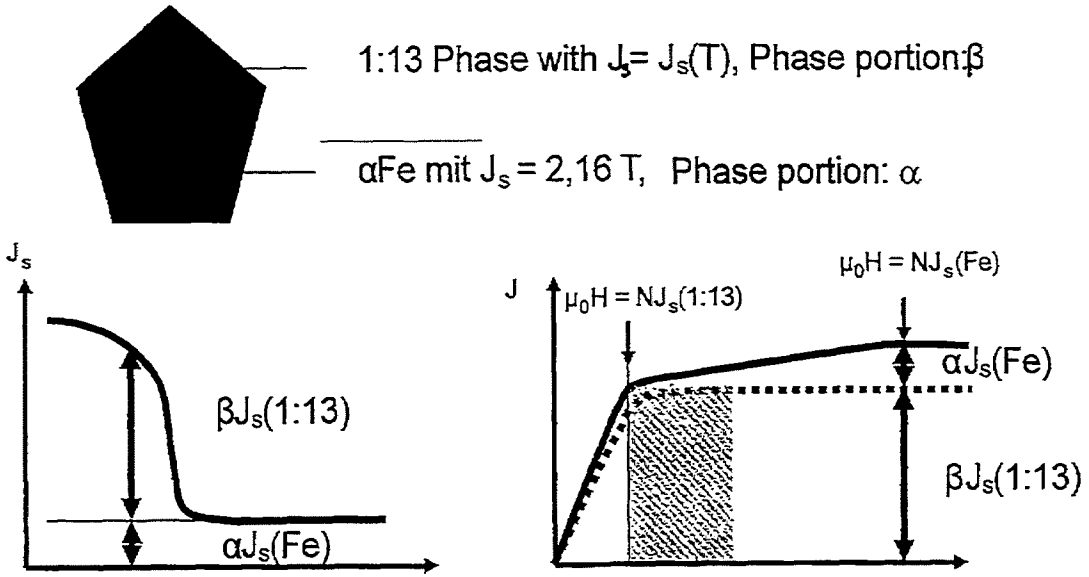
FIG. 12 schematically illustrates the influence of αFe on thermomangetic separation.

FIG. 12 illustrates the influence of αFe on thermomangetic separation, whereby 1:13 phase with $J_s=J_s(T)$, phase component: β and αFe with $J_s$=2.16 T, phase component: α. $J_s$ is the saturation polarisation of the magnetocaloric phase at the temperature at which the TMS is carried out. In order to achieve a clean separation, $\beta J_s$ should be as great as possible in comparison to $3\alpha B_z$. FIG. 12 illustrates the requirement for the $B_z$ selected to be only slightly greater than $J_s/3$. Conditions suitable for use in thermomagnetic separation are indicated in FIG. 12 by the grey shaded region.

In light of FIG. 12, in one embodiment, the saturation magnetisation of the magnetocaloric phase, at which the lift-off condition (9) is fulfilled, is placed in the region where the temperature dependency of the saturation magnetisation is the highest in order to achieve greatest separation sharpness. The gradient selected in equation (9) should be sufficiently low and the $B_z$ selected in equation (10) sufficiently high for the particles not to lift off until the relatively high desired saturation polarisation of approx. 0.5 T is reached. This approach may be used for individual particles. However, in practice, bulk powders are used and such high degrees of magnetisation lead to considerable interaction between powder particles and thus to a deterioration in separation sharpness. The next section describes an estimation of the degree of polarisation which can be expected in case of disruptive interaction of this kind.

Particle Interaction

To estimate the interaction between two neighbouring particles it is sufficient in a first approximation simply to describe the particles by their dipole moment $\mu_1$ and $\mu_2$. The use of bold characters indicates vectorial values. The magnetostatic dipole interaction energy is generally:

$$E_{Dipole} = \frac{\mu_0}{4\pi r^3}\left(\mu_1 \cdot \mu_2 - \frac{3}{r^2}(\mu_1 \cdot r)(\mu_2 \cdot r)\right) \tag{12}$$

Here r is the position vector between the mid points of the two particles. If one considers the special cases at issue here in which the direction of $\mu_1$ and $\mu_2$ coincides with the z-axis, it is easy with the help of equation (12) to understand the known condition in which it is more energetically favourable to place the particles one behind another along the z-axis (μ parallel to r) instead of side by side (μ perpendicular to r). This leads to the known formation of powder chains in the direction of the magnetic field and to the rejection of chains perpendicular to it.

Figure 13:
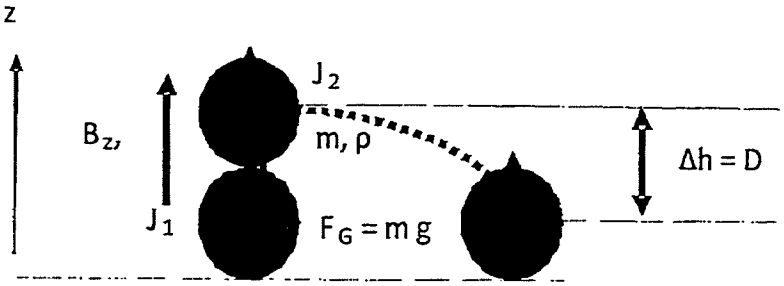
FIG. 13 schematically illustrates chain formation of magnetized particles.

If the direction of the magnetic field is parallel to the weight force, one particle must be lifted by the diameter of another to form the first element of a powder chain as illustrated in FIG. 13.

If the work required to do this is less than the gain in magnetostatic energy, the powder chain forms once activated appropriately. FIG. 13 illustrates the conditions required for the most simple case of spherical particles of identical size.

D is the diameter of the particles. The polarisation J is forced in z direction by the magnetic field, $B_z$ fulfilling the saturation condition (10), making the polarisation independent of the relative positions of the particles. With R as the radius of the particles:

$$\mu = \frac{J}{\mu_0}V = \frac{J}{\mu_0}\frac{4\pi R^3}{3}. \tag{13}$$

In the special case under consideration here, the inclusion of equation (13) in equation (12) results in a powder chain consisting of two spheres with the following magnetostatic energy:

$$E_{Dipole} = -\frac{J_1 J_2 \pi R^3}{9\mu_0} = -\frac{J_1 J_2 m}{12\rho\mu_0}. \tag{14}$$

In the boundary case this reduction in magnetostatic energy has to compensate for the increase in potential energy as the powder chain is formed, thereby producing the following equilibrium condition:

$$J_1 J_2 = 12\mu_0 \rho g D. \tag{15}$$

If $J_1=J_2$ it is possible to calculate the boundary polarisation as powder chain formation occurs dependent on D. A typical $LaFeMnSiH_{sat}$ density of approx. 7.1 g/cm$^3$ results in a boundary polarisation of approx. 0.033 T at a particle diameter of 1 mm and a boundary polarisation of only approx. 0.010 T at a particle diameter of 100 μm. To form longer chains, newly adjoining particles have to overcome an ever increasing height difference as a result of which the degree of magnetisation required increases with the root of the chain length in accordance with equation (15).

If the powder chain consists of uniform particles with the same magnetic transition temperature, thermomagnetic separation can be performed. As soon as the saturation magnetisation is sufficiently high—due to the falling temperature—to fulfil the lift off condition (9), the entire chain is lifted out of the bulk material. In accordance with equation (15), it is precisely the particles with the highest saturation magnetisation and thus the highest magnetic transition temperatures which form the first chains.

However, the attractive forces between the particles within a chain may be greater than the weight force and that as a result particles which are not yet sufficiently magnetically saturated can be torn off "piggy-backed" on a particle with a sufficiently high Curie temperature. The force between two particles touching as shown in FIG. 13 can be calculated by differentiating (14) with respect to z:

$$F_z = -\frac{J_1 J_2 \pi D^2}{24\mu_0}. \quad (16)$$

Making this force equal to the weight force acting on the lower particle results in a condition for the continued adherence of a particle in a manner similar to equation (15):

$$J_1 J_2 = 4\mu_0 \rho g D. \quad (17)$$

The mean polarisation which carries away a neighbouring particle is therefore still lower by a factor of $\sqrt{3}$ than the polarisation required to form a powder chain. In order to minimise the influence of powder particle interaction, the saturation polarisation for particles with a diameter of a few hundred μm should be significantly less than 0.1 T. In addition, it makes sense to keep the bulk powder relatively thin and to suppress the coagulation of powder particles by mechanical vibration. This can be done by a combination of transporting the powder in vibrating conveyers and the use of the lowest possible magnetic field to carry out thermomagnetic separation.

Calculated Examples and Working Diagrams

Figure 14:
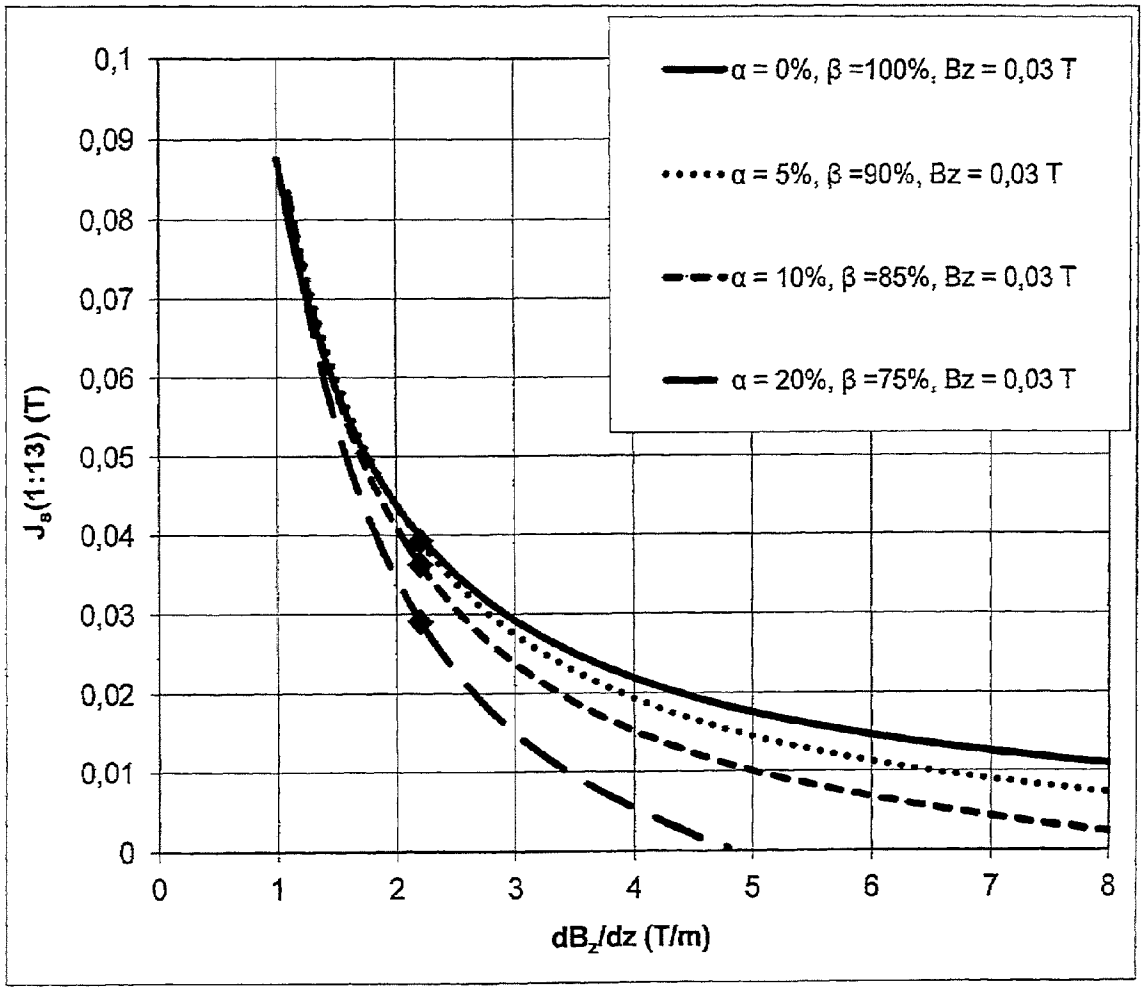
FIG. 14 illustrates a diagram of calculated saturation magnetisation required to lift off a particle.

The conditions deduced above are best discussed with the help of a diagram which plots the saturation magnetisation required to lift off a particle in accordance with equation (9) as a function of magnetic field gradient. This is illustrated in FIG. 14 for a series of field strengths Bz, αFe fractions α and fractions of the magnetocalorically active 1:13 phase β. The typical $LaFeMnSiH_{sat}$ density value of 7.1 g/cm$^3$ was used.

Here the continuous black curve represents the case of a sample consisting of 100% 1:13 phase and containing no αFe. In this case according to equation (9) the bias point depends not on the field strength but merely on the gradient. However, the saturation condition (10) still needs to be fulfilled. A $B_z$ of 0.03 T was assumed for the calculation of the black line. As a consequence of the saturation condition, the line ends at a $dB_z/dz$ of approx. 1 T/m at a saturation polarisation of 0.09 T. This means that at a field strength of 0.03 T the gradient must be at least approx. 1 T/m if thermomagnetic separation is to function at all. The embodiments described above use at $B_z$=0.03 T and a gradient of 2.2 T/m. If 1:13 particles are cooled slowly from a temperature above their Curie temperature in this field configuration, their saturation magnetisation increases until the particle is lifted out of the bulk powder at a value of approx. 0.04 T.

The dashed lines in FIG. 14 illustrate the effect of an increasing αFe content at a field strength of 0.03 T. An αFe content of 5% has only a minor effect on the course of the work curve (cf. solid black and dashed lines). At 10% (short-dashed line) and 20% (long-dashed line), however, the saturation polarisation of the 1:13 phase for higher gradients required to lift off the particles falls significantly. At 20% αFe it was even negative from a gradient of approx. 5 T/m $J_s$ (1:13). This means that under these conditions the force acting on the αFe content alone is sufficient to lift off the particles. This corresponds to the intermediate phase condition (11) which can also be rewritten as $J_s$ (1:13)>0 if included in (9).

At a gradient of 2.2 T/m, a 20% αFe content leads to a reduction in $J_s$ (1:13) from approx. 0.04 to approx. 0.03 T. This reduces the separation sharpness of the thermomagnetic separation by different αFe contents. FIG. 14 also illustrates that the lower the gradient, the lower the sensitivity to αFe content. At $B_z$=0.03 T the lines for the various αFe contents at the minimum gradient permissible for this field strength of approx. 1 T/m practically converge.

Figure 15:
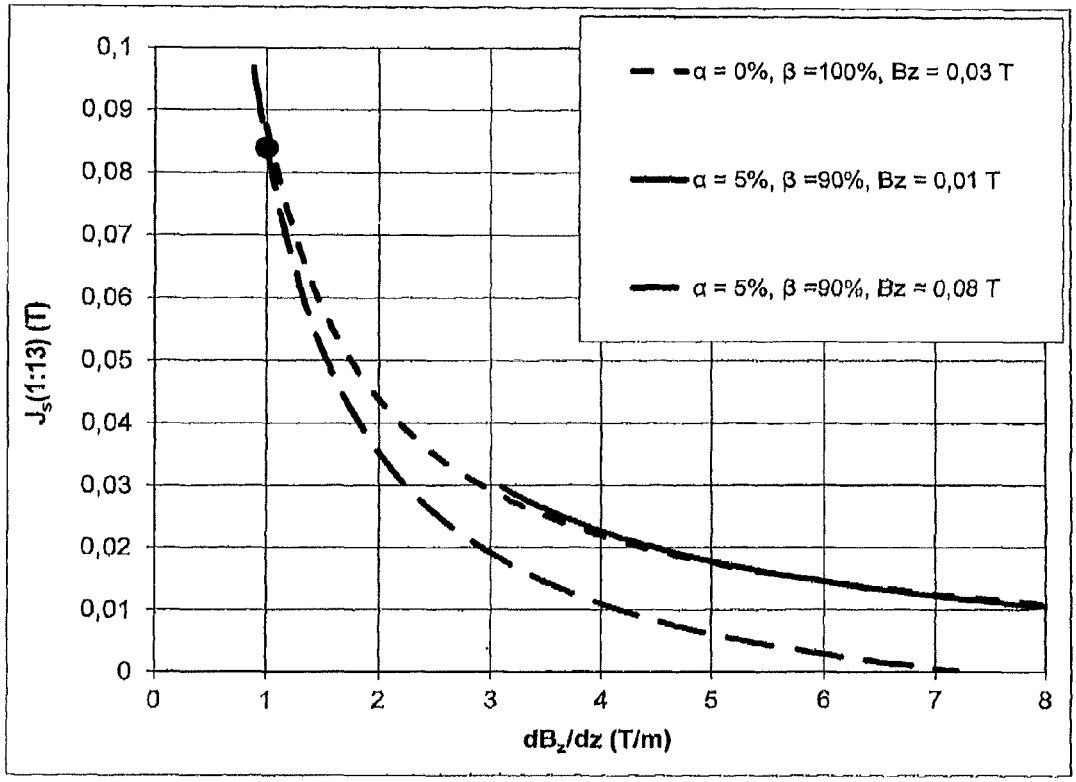
FIG. 15 illustrates a diagram of calculated saturation magnetisation required to lift off a particle.

Finally, by means of the solid black ($B_z$=0.01 T), short dashed ($B_z$=0.03 T) and long dashed ($B_z$=0.08 T) lines FIG. 15 also illustrates the influence of magnetic field strength for typical $LaFeMnSiH_{sat}$ at 5% αFe and 90% 1:13 phase. For $B_z$=0.08 T and a gradient of approximately 1 T/m it is still possible to carry out a reasonable thermomagnetic separation. However, the relatively high $J_s$ (1:13) of approx. 0.085 T required leads to a significantly increased tendency to chain formation.

As expected according to equation (9), the influence of αFe decreases with $B_z$ and for $B_z$=0.01 T the work curve is almost identical to the αFe-free ideal curve. Taking into account the results deduced in above, this gives a $B_z$ of approx. 0.01 T at a gradient of approx. 4-5 T/m as a particularly preferred bias point for thermomagnetic separation. In this region the expected αFe influence is low and due to the relatively low 1:13 phase saturation polarisation of approx. 0.02 T the expected interaction between the particles is also low.

The invention having been described with reference to certain specific embodiments and examples, it will be understood that these embodiments and examples are illustrative, and not limiting of the appended claims.

The invention claimed is:

1. A method for classifying articles comprising magnetocalorically active material according to magnetic transition temperature, comprising:

providing a source of articles to be classified, the source comprising articles comprising magnetocalorically active materials having differing magnetic transition temperatures, wherein the articles comprise one or more of a $La(Fe_{1-b}Si_b)_{13}$-based phase, a $Gd_5$ (Si, Ge)$_4$-based phase, a Mn (As, Sb)-based phase, a MnFe (P, As)-based phase, a Tb—Gd-based phase, a (La, Ca, Pr, Nd, Sr)$MnO_3$-based phase, a Co—Mn—(Si, Ge)-based phase and a $Pr_2$ (Fe, Co)$_{17}$-based phase;

sequentially applying a magnetic field at differing temperatures to the source, the magnetic field being sufficient to exert a magnetic force on the source that is greater than the inertia of a fraction of the articles causing the fraction of the articles to move and thereby produce an article fraction for each temperature at which a magnetic field is applied, wherein the sequentially applying a magnetic field at differing temperatures comprises placing the source in a thermally conductive container, and altering the temperature of the container to thereby alter the temperature of the source by thermal conduction, and collecting the article fraction at each temperature at which a magnetic field is applied to provide a plurality of separate article fractions of differing magnetic transition temperature, thereby classifying the articles comprising magnetocalorically active material according to magnetic transition temperature.

2. The method according to claim 1, wherein the sequential applying a magnetic field at differing temperatures to the source comprises:

setting the temperature of the source at a temperature $T_1$ corresponding to a first desired magnetic transition temperature $T_{trans1}$, applying a magnetic field to the source, causing a first article fraction within the source having a magnetic transition temperature of $T_{trans1}$±3° C. to be magnetically attracted to the magnet and removed from the source, and collecting the first article fraction.

3. The method according to claim 2, wherein the sequentially applying a magnetic field at differing temperatures to the source further comprises:

altering the temperature of the source to a temperature $T_2$ corresponding to a second desired magnetic transition temperature $T_{trans2}$, wherein $T_{trans2} \neq T_{trans1}$, applying a magnetic field to the source, thereby causing a second article fraction within the source having a magnetic transition temperature of $T_{trans2} \pm 3°$ C. to be magnetically attracted to the magnet and removed from the source, and collecting the second article fraction.

4. The method according to claim 3, wherein $0.5° \text{ C.} \leq |T_2 - T_1| \leq 5°$ C.

5. A method for classifying articles comprising magnetocalorically active material according to magnetic transition temperature, comprising:

providing a source of articles to be classified, the source comprising articles comprising magnetocalorically active materials having differing magnetic transition temperatures, wherein the articles comprise one or more of a $La(Fe_{1-b}Si_b)_{13}$-based phase, a $Gd_5$ (Si, Ge)$_4$-based phase, a Mn (As, Sb)-based phase, a MnFe (P, As)-based phase, a Tb—Gd-based phase, a (La, Ca, Pr, Nd, Sr)$MnO_3$-based phase, a Co—Mn—(Si, Ge)-based phase and a $Pr_2$ (Fe, Co)$_{17}$-based phase;

sequentially applying a magnetic field at differing temperatures to the source, the magnetic field being sufficient to exert a magnetic force on the source that is greater than the inertia of a fraction of the articles causing the fraction of the articles to move and thereby produce an article fraction for each temperature at which a magnetic field is applied, wherein the sequentially applying a magnetic field at differing temperatures comprises subjecting the source to a temperature gradient, moving the source along the temperature gradient to thereby alter the temperature of the source by thermal conduction and removing an article fraction from the source at different temperatures along the temperature gradient.

6. The method according to claim 5, wherein the moving the source along the temperature gradient comprises:

moving the source along the temperature gradient from a higher temperature to a lower temperature, or from a lower temperature to a higher temperature.

7. The method according to claim 5, wherein the moving the source along the temperature gradient comprises:

placing the source on a band which carries the source through the temperature gradient.

8. The method according to claim 7, wherein the moving of the source along the temperature gradient comprises vibration of the band.

9. The method according to claim 7, wherein the moving of the source through the temperature gradient is continuous and wherein the applying a magnetic field comprises applying at intervals along the band, wherein the source has a different temperature at each interval.

10. The method according to claim 1, wherein the source is supported on a surface and the magnetic field is applied perpendicularly to the surface.

11. The method according to claim 1, wherein the source is supported on a surface and the magnetic field is applied parallel to the surface.

12. The method according to claim 11, further comprising rotating the magnetic field about an axis perpendicular to the surface.

13. The method according to claim 5, wherein the temperature gradient lies in the range of 10° C./m to 200° C./m.

14. The method according to claim 1, wherein the sequentially applying a magnetic field comprises applying a current to an electromagnet or applying a magnetic field from a permanent magnet.

15. The method according to claim 14, further comprising positioning a first magnet adjacent a first side of the source.

16. The method according to claim 15, further comprising positioning a further magnet adjacent the opposing side of the source.

17. The method according to claim 1, wherein the sequentially applying a magnetic field comprises applying a magnetic field of 0.003 T to 0.3 T or 0.01 T to 0.1 T.

18. The method according to claim 1, wherein the sequential applying of a magnetic field comprises applying a magnetic field gradient to the source.

19. The method according to claim 18, wherein the magnetic gradient is 0.5 T/m to 10 T/m.

20. The method according to claim 1, wherein the magnetic field applied, B, is such that $B \geq J_s/3$, where $J_s$ is the saturation polarization.

21. The method according to claim 1, wherein the articles have a maximum diameter of 2 mm.

22. The method according to claim 1, wherein the articles are particles having a diameter within the range of 50 μm to 750 μm.

23. The method according to claim 1, further comprising securing an article fraction on a removal surface.

24. A method of fabricating a magnetocalorically active working component for magnetic heat exchange, comprising:

classifying articles comprising magnetocalorically active material according to the method of claim 1 thereby producing a plurality of particle fractions having differing average magnetic transition temperatures, and arranging the particle fractions in order of increasing or decreasing average magnetic transition temperature and producing a magnetocalorically active working component for magnetic heat exchange.

25. The method according to claim 24, further comprising compacting a first particle fraction before arranging a further particle fraction on the first particle fraction.

26. The method according to claim 25, further comprising compacting the further particle fraction.

27. The method according to claim 24, further comprising:

heat treating and sintering the particle fractions after the particle fractions are arranged in order of increasing or decreasing magnetic transition temperature to produce a sintered magnetocalorically active working component for magnetic heat exchange.

28. The method according to claim 24, further comprising mixing the particles of the particle fraction with adhesive before compaction.

29. The method according to claim 28, further comprising curing the adhesive after compaction.

30. The method according to claim 28, wherein the adhesive is cured at a temperature, $T_{cure}$, of $0° \text{ C.} < T_{cure} < 200°$ C.

* * * * *